US005568968A

United States Patent [19]

Jaramillo

[11] Patent Number: 5,568,968

[45] Date of Patent: Oct. 29, 1996

[54] ADJUSTABLE DROP LIGHT APPARATUS

[76] Inventor: Lola Jaramillo, P.O. Box 1178, Claypool, Ariz. 85532

[21] Appl. No.: 415,704

[22] Filed: Apr. 3, 1995

[51] Int. Cl.[6] ..... F21V 21/08

[52] U.S. Cl. ..... 362/376; 362/396; 362/398; 248/299.1; 248/691; 248/683

[58] Field of Search ..... 362/398, 396, 362/376, 285, 427; 248/299.1, 292.14, 308, 691, 683, 206.5

[56] References Cited

U.S. PATENT DOCUMENTS

| | | | |
|---|---|---|---|
| D. 309,705 | 8/1990 | Rodden . | |
| 2,506,400 | 5/1950 | Wietz | 362/398 |
| 2,669,650 | 2/1954 | Smith | 248/206.5 |
| 2,747,079 | 5/1956 | Kubiliunas | 362/398 |
| 3,828,181 | 8/1974 | Goodwin | 362/396 |
| 4,019,047 | 4/1977 | Frey | 248/683 |
| 4,378,473 | 3/1983 | Noorigian . | |
| 4,574,220 | 3/1986 | Tate . | |
| 5,213,412 | 5/1993 | Ciallella | 362/398 |
| 5,257,172 | 10/1993 | Erickson | 362/226 |

*Primary Examiner*—Denise L. Gromada
*Assistant Examiner*—Sara Sachie Raab

[57] ABSTRACT

An adjustable drop light apparatus includes a lamp assembly connected to and supported by a handle assembly. A protective housing assembly is supported by the handle assembly and protects the light bulb of the lamp assembly. An orientation adjustment assembly is attached to the protective housing assembly, and a suspension assembly is adjustably connected to the orientation adjustment assembly. The suspension assembly includes a magnet retainer which retains a magnet. The suspension assembly also includes a hook assembly connected to the magnet. The magnet includes a retention well. The hook assembly includes a pivot bracket connected to the magnet within the retention well, and the hook assembly includes a selectably pivotable hook which is pivotally connected to the pivot bracket. The retention well has a well depth; the selectably pivotable hook has a hook thickness; and the well depth is greater than the hook thickness enabling the pivotable hook to be stored within the retention well. The orientation adjustment assembly includes a captive rail connected to the protective housing assembly. A head assembly is connected to the suspension assembly. The head assembly includes a head portion adapted to be captured by the captive rail. Also, the head assembly includes a lock nut supported by the suspension assembly, a body portion adjustably is connected to the lock nut, and a head portion connected to the body portion.

8 Claims, 3 Drawing Sheets

ADJUSTABLE DROP LIGHT APPARATUS

BACKGROUND OF THE INVENTION

1. Field of the Invention

The present invention relates generally to illumination devices and, more particularly, to portable, handle-containing illumination devices often referred to as drop lights.

2. Description of the Prior Art

The use of portable, handle-containing illumination devices known as drop lights is well known. A drop light generally has a light bulb, a protective housing for the bulb, and a long power cord. A hook is generally present on the protective housing to enable the housing to be suspended from an overhead structure. The long power cord enables the light to be "dropped" or hang from a structure onto which a portion of the cord is supported.

More specifically, throughout the years, a number of innovations have been developed relating to drop lights, and the following U.S. Pat. Nos. are representative of some of those innovations: 4,378,473; 4,574,220; 5,213,412; 5,257,172; and Des. 309,705. More specifically, U.S. Pat. No. 4,378,473 discloses a retractable drop light which includes a light bulb enclosed in a protective housing. U.S. Pat. No. 4,574,220 discloses a flucent drop light in combination with an electric power bus.

U.S. Pat. No. 5,213,412 discloses a drop light that has hook assembly and a magnet that are alternatively selectable. A removable and replaceable cap is provided that contains a hook. When the magnet is used for affixing the drop light to a support, the removable and replaceable cap is removed, and the magnet is employed. Alternatively, if the hook is to be used for affixing the drop light to a support, the removable and replaceable cap is placed over the magnet, and the hook is used. The use of a removable and replaceable cap may pose an inconvenience, and the cap may be lost or misplaced when not in use. In this respect, it would be desirable if a drop light were provided which does not employ a removable and replaceable cap that contains a hook. It is noted that both the removable and replaceable cap and the magnet are located along a longitudinal axis of the drop light. As such, the drop light can be supported by the cap or the magnet in essentially one orientation, along the longitudinal axis of the device. In this respect, it would be desirable if a drop light were provided which can be supported in a variety of orientations besides the longitudinal axis of the drop light.

U.S. Pat. No. 5,257,172 discloses a trouble light having a selectably plugged or unplugged connection between an electrical cord and the trouble light. U.S. Pat. No. Des. 309,705 discloses a holder for a drop light. This holder has a lower bracket for holding the handle portion of the drop light and has an upper bracket for receiving a hook on the drop light. The upper bracket is adjustable longitudinally with respect to the lower bracket to accommodate drop lights of different sizes.

Still other features would be desirable in an adjustable drop light apparatus. For example, it would be desirable if an adjustable drop light apparatus had both a support magnet and a support hook for supporting a drop light. It would also be desirable if both a magnet and a hook of an adjustable drop light apparatus were adjustable so that the drop light could be oriented in a variety of orientations. It would also be desirable for both a magnet and a hook of an adjustable drop light apparatus to share a common adjustable orientation assembly.

Thus, while the foregoing body of prior art indicates it to be well known to use a drop light apparatus, the prior art described above does not teach or suggest a drop light apparatus which has the following combination of desirable features: (1) does not employ a removable and replaceable cap that contains a hook; (2) can be supported in a variety of orientations besides the longitudinal axis of the drop light; (3) has both a support magnet and a support hook for supporting a drop light; (4) has both an adjustable magnet and an adjustable hook so that the drop light can be oriented in a variety of orientations; and (5) has both a magnet and a hook which share a common adjustable orientation assembly. The foregoing desired characteristics are provided by the unique adjustable drop light apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an adjustable drop light apparatus includes a lamp assembly connected to and supported by a handle assembly. A protective housing assembly is supported by the handle assembly and protects a portion of the lamp assembly. An orientation adjustment assembly is attached to the protective housing assembly, and a suspension assembly is adjustably connected to the orientation adjustment assembly. The suspension assembly includes a magnet retainer, and a magnet is retained by the magnet retainer.

The suspension assembly includes a hook assembly. More specifically, the suspension assembly includes a magnet retainer, a magnet retained by the magnet retainer, and a hook assembly connected to the magnet. The magnet includes a retention well. The hook assembly includes a pivot bracket connected to the magnet within the retention well, and the hook assembly includes a selectably pivotable hook which is pivotally connected to the pivot bracket.

The retention well has a well depth; the selectably pivotable hook has a hook thickness; and the well depth is greater than the hook thickness.

The lamp assembly and the handle assembly are connected together along a longitudinal axis, and the orientation adjustment assembly is positioned on the protective housing assembly parallel to the longitudinal axis. The orientation adjustment assembly includes a captive rail connected to the protective housing assembly. A head assembly is connected to the suspension assembly. The head assembly includes a head portion adapted to be captured by the captive rail. Also, the head assembly includes a lock nut supported by the suspension assembly, a body portion adjustably is connected to the lock nut, and a head portion connected to the body portion. The suspension assembly includes a lock-retention portion adapted for retaining the lock nut.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable drop light apparatus which has all of the advantages of the prior art and none of the disadvantages.

It is another object of the present invention to provide a new and improved adjustable drop light apparatus which may be easily and efficiently manufactured and marketed.

It is a further object of the present invention to provide a new and improved adjustable drop light apparatus which is of durable and reliable construction.

An even further object of the present invention is to provide a new and improved adjustable drop light apparatus which is susceptible of a low cost of manufacture with regard to both materials and labor, and which accordingly is then susceptible of low prices of sale to the consuming public, thereby making such adjustable drop light apparatus available to the buying public.

Still yet a further object of the present invention is to provide a new and improved adjustable drop light apparatus which does not employ a removable and replaceable cap that contains a hook.

Still another object of the present invention is to provide a new and improved adjustable drop light apparatus that can be supported in a variety of orientations besides the longitudinal axis of the drop light.

Yet another object of the present invention is to provide a new and improved adjustable drop light apparatus which has both a support magnet and a support hook for supporting a drop light.

Even another object of the present invention is to provide a new and improved adjustable drop light apparatus that has both an adjustable magnet and an adjustable hook so that the drop light can be oriented in a variety of orientations.

Still a further object of the present invention is to provide a new and improved adjustable drop light apparatus which has both a magnet and a hook which share a common adjustable orientation assembly.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a side view showing a preferred embodiment of the adjustable drop light apparatus of the invention attached to an overhead support surface by a magnet at an obtuse angle with respect to the support surface.

DESCRIPTION OF THE PREFERRED EMBODIMENT

Figure 2:
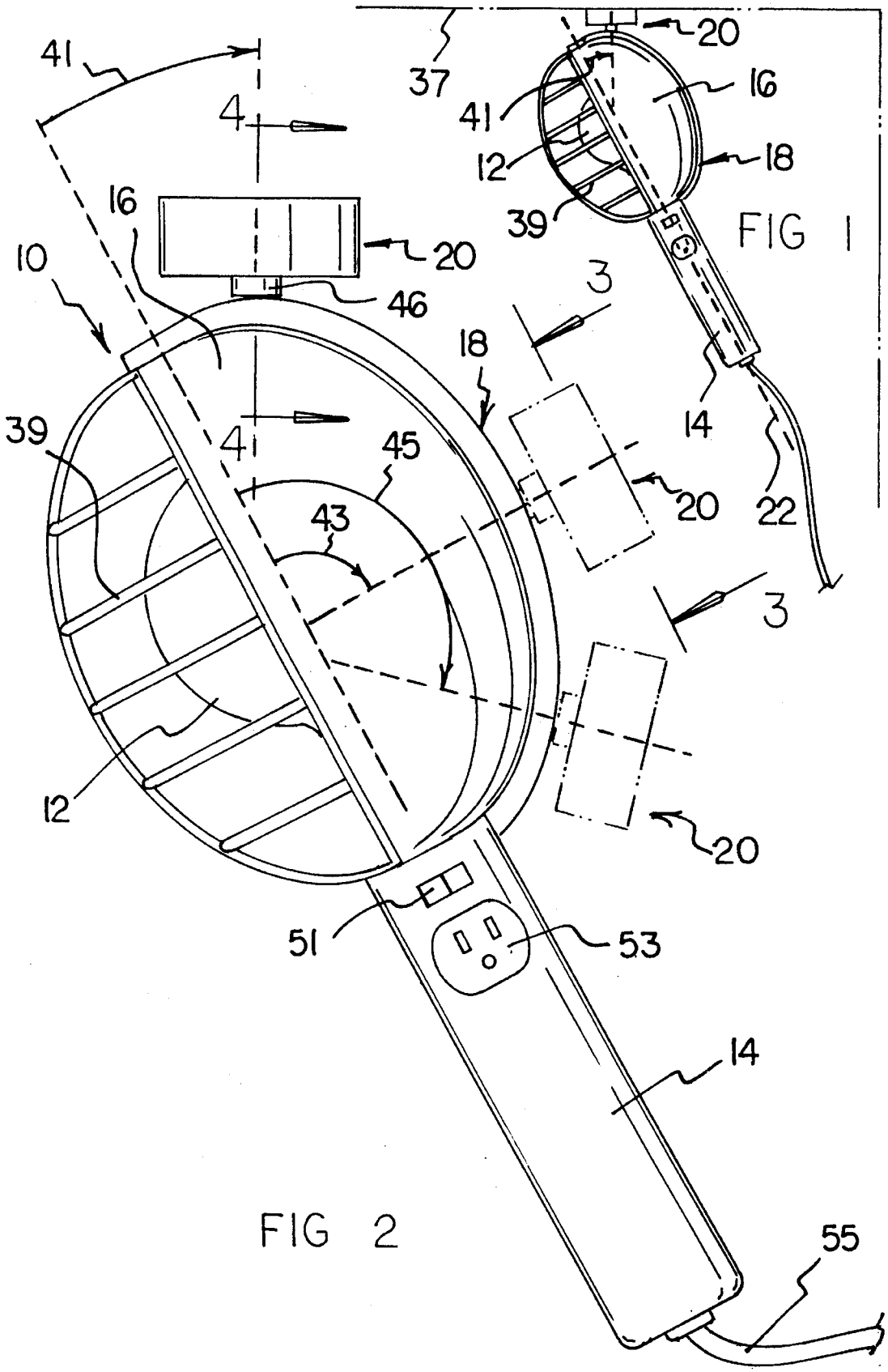
FIG. 2 is an enlarged view of the embodiment of the invention shown in FIG. 1, further showing a second adjustment position of the magnet which is shown in broken lines.
Figure 3:
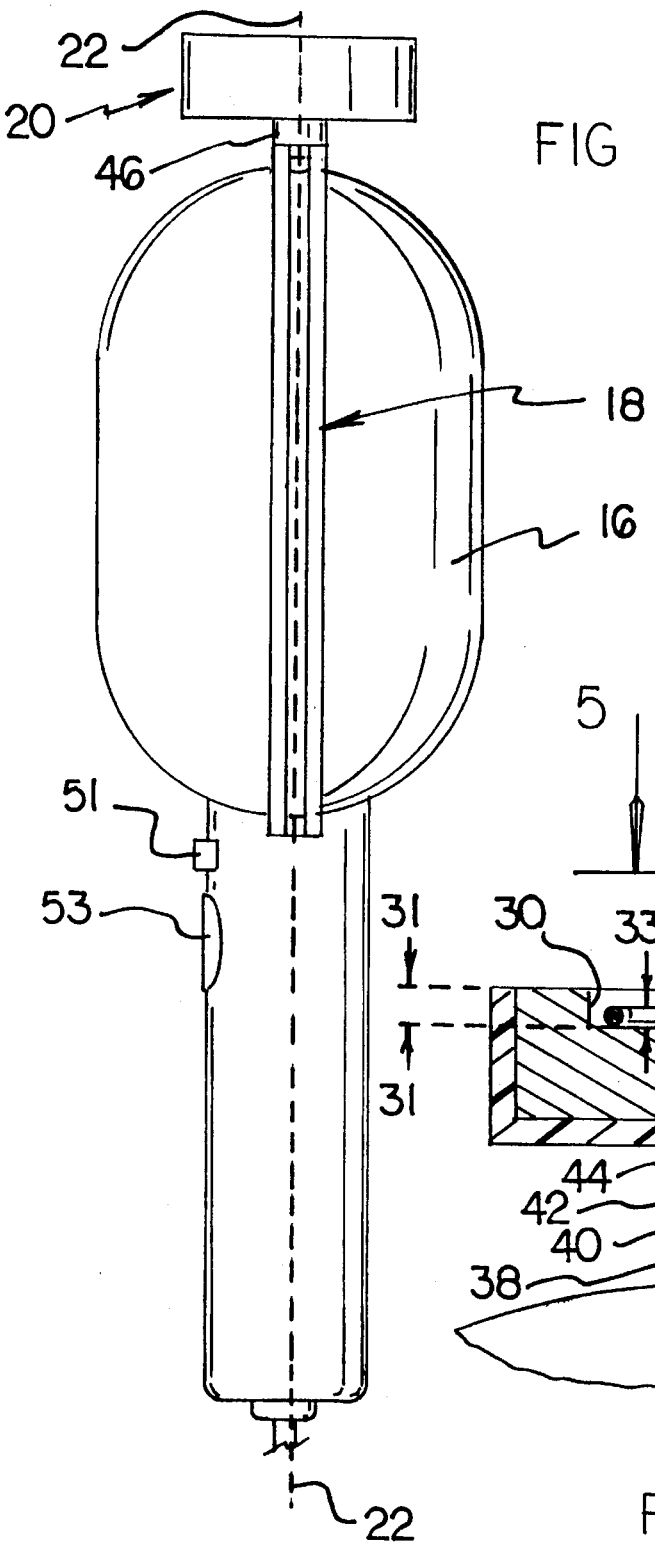
FIG. 3 is a rear view of the embodiment of the adjustable drop light apparatus of FIG. 2 taken along line 3—3 thereof.

With reference to the drawings, a new and improved adjustable drop light apparatus embodying the principles and concepts of the present invention will be described.

Turning to FIGS. 1–6, there is shown an exemplary embodiment of the adjustable drop light apparatus of the invention generally designated by reference numeral 10. In its preferred form, adjustable drop light apparatus 10 includes a lamp assembly 12 connected to and supported by a handle assembly 14. A protective housing assembly 16 is supported by the handle assembly 14 and protects a portion of the lamp assembly 12. An orientation adjustment assembly 18 is attached to the protective housing assembly 16, and a suspension assembly 20 is adjustably connected to the orientation adjustment assembly 18. A gridwork 39 is connected to the protective housing assembly 16 to protect the lamp assembly 12 and to permit light from the lamp assembly 12 to emerge from the adjustable drop light apparatus 10 of the invention. The suspension assembly 20 includes a magnet retainer 24, and a magnet 26 is retained by the magnet retainer 24.

The suspension assembly 20 includes a hook assembly 28. More specifically, the suspension assembly 20 includes a magnet retainer 24, a magnet 26 retained by the magnet retainer 24, and a hook assembly 28 connected to the magnet 26. The magnet 26 includes a retention well 30. The hook assembly 28 includes a pivot bracket 32 connected to the magnet 26 within the retention well 30, and the hook assembly 28 includes a selectably pivotable hook 34 which is pivotally connected to the pivot bracket 32.

The retention well 30 has a well depth 31; the selectably pivotable hook 34 has a hook thickness 33; and the well depth 31 is greater than the hook thickness 33. When the selectably pivotable hook 34 is in the storage position shown in FIG. 5, the top surface 35 of the magnet 26 is unobstructed and is available for contact with a horizontal support surface 37 as shown in FIG. 1. Alternatively, when the selectably pivotable hook 34 is in a hook-usable position shown in FIG. 6, the selectably pivotable hook 34 is capable of being hung from a hook-receivable portion of the horizontal support surface 37.

The lamp assembly 12 and the handle assembly 14 are connected together along a longitudinal axis 22, and the orientation adjustment assembly 18 is positioned on the protective housing assembly 16 parallel to the longitudinal axis 22. The orientation adjustment assembly 18 includes a captive rail 36 connected to the protective housing assembly 16. A head assembly 38 is connected to the suspension assembly 20. The head assembly 38 includes a head portion 40 adapted to be captured by the captive rail 36. Also, the head assembly 38 includes a lock nut 44 supported by the suspension assembly 20, a body portion 42 adjustably is connected to the lock nut 44, and a head portion 40 connected to the body portion 42. The suspension assembly 20 includes a lock-retention portion 46 adapted for retaining the lock nut 44. The protective housing assembly 16 is concavely shaped so as to partially enclose an electric light bulb.

In using the adjustable drop light apparatus 10 of the invention, to use the magnet 26 against a ferro-magnetic horizontal support surface 37, the selectably pivotable hook 34 is rotated to placement within the retention well 30 as shown in FIGS. 1–5 which show the selectably pivotable hook 34 in the storage position. Alternatively, to suspend the adjustable drop light apparatus 10 from a hook-receivable portion of the horizontal support surface 37 (not shown), the selectably pivotable hook 34 is rotated around the pivot bracket 32 to be placed in the hook-usable position shown in FIG. 6.

The suspension assembly 20 can be adjusted through a wide range of adjustment orientations with respect to the longitudinal axis 22. For example, as shown in FIGS. 1 and 2, the suspension assembly 20 is oriented at an acute first adjustment angle 41 with respect to the longitudinal axis 22. An alternative second orientation of the suspension assembly 20 with respect to the longitudinal axis 22 is shown in FIG. 2. In the second orientation, the suspension assembly 20 is shown in broken lines and is shown to be oriented at a right second adjustment angle 43 with respect to the longitudinal axis 22. An alternative third orientation of the suspension assembly 20 with respect to the longitudinal axis 22 is also shown in FIG. 2. In the third orientation, the suspension assembly 20 is shown in broken lines and is shown to be oriented at an oblique third adjustment angle 45 with respect to the longitudinal axis 22.

From the above description, it is clear that the suspension assembly 20 can be adjusted with respect to the longitudinal axis 22 through a wide range of angles of orientation.

Figure 4:
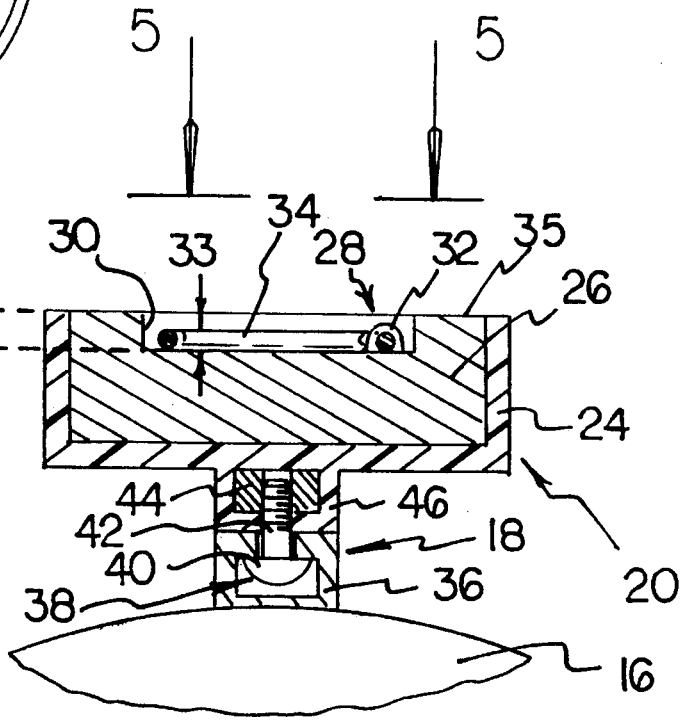
FIG. 4 is an enlarged cross-sectional view of the circled area 4 shown in FIG. 3.
Figure 5:
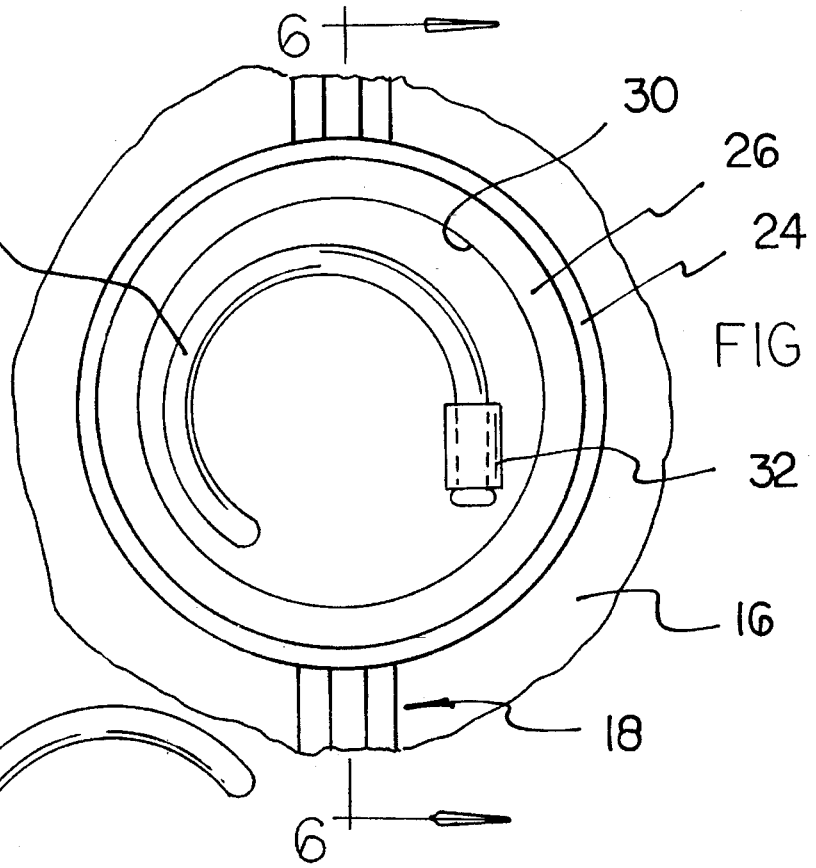
FIG. 5 is an enlarged partial top view of a portion of the embodiment of the invention shown in FIG. 4.taken along line 5—5 of FIG. 4.
Figure 6:
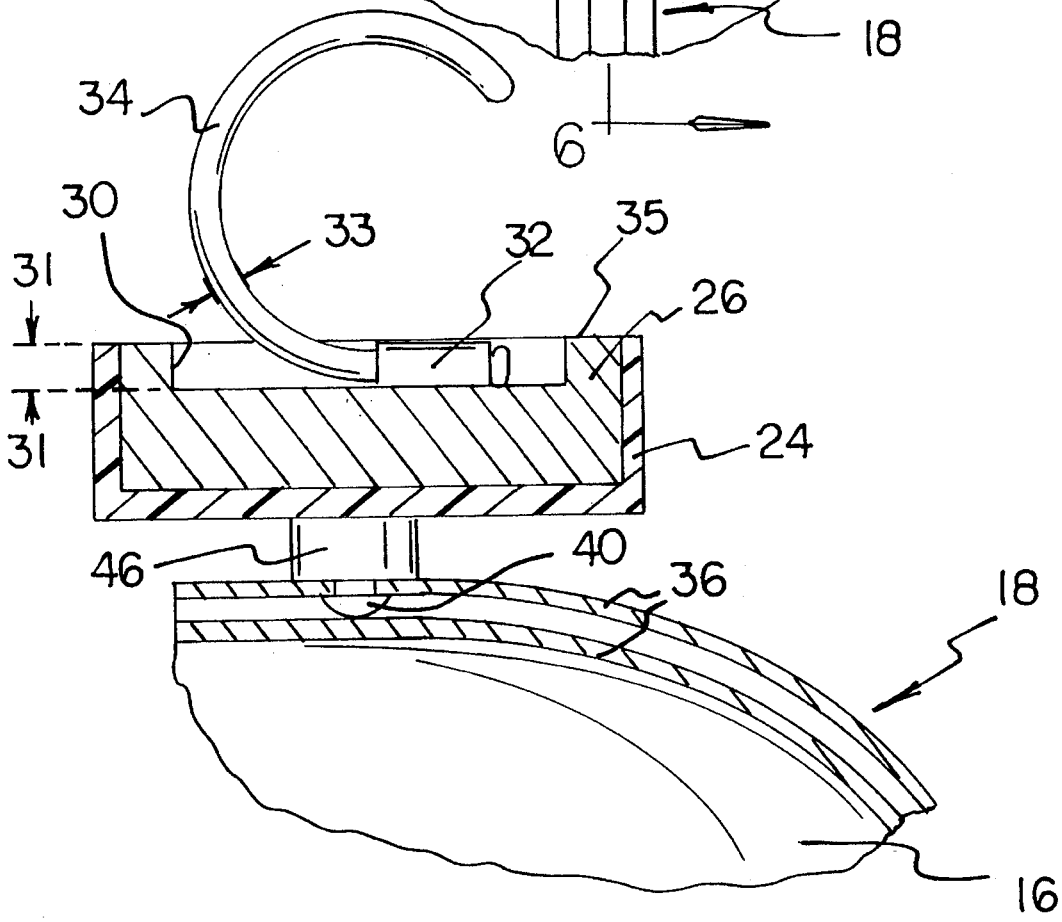
FIG. 6 an enlarged cross-sectional view of a portion of the embodiment of the invention shown in FIG. 5 taken along line 6—6 of FIG. 5.

With reference to FIG. 4, one way to change the orientation from one angle of orientation to another is to turn the lock nut 44 with respect to the body portion 42 of the head assembly 38. When this is done, the head portion 40 of the head assembly 38 exerts less of a clamping action on the captive rail 36, which in turn exerts less of a clamping action on the lock-retention portion 46. With a reduced clamping action urging the captive rail 36 and the lock-retention portion 46 together, the suspension assembly 20 can be readily moved along the captive rail 36. Once a new angle of orientation is selected, the lock nut 44 can be retightened causing the head portion 40 of the head assembly 38 to exert clamping pressure against the captive rail 36 which, in turn, exerts clamping pressure against the lock-retention portion 46. When the lock nut 44 is properly tightened, the suspension assembly 20 is locked into a selected orientation angle with respect to the longitudinal axis 22. The adjustable drop light apparatus 10 of the invention can have conventional features such as an on/off switch 51, a socket assembly 53, and an electrical cord assembly 55 that has a plug that can be plugged into a conventional power source.

It is clear that the adjustable drop light apparatus 10 of the invention allows a mechanic, millwright, welder, and any other craftsman to use the adjustable drop light apparatus 10 in steel duct work, in boilers, and in any environment where there is a need to attach the adjustable drop light apparatus 10 to a metal support surface. In addition. An automobile mechanic can also use the adjustable drop light apparatus 10 under the hood of an automobile as well as under a vehicle. In the mining industry, the adjustable drop light apparatus 10 can be used in ballmills, hoppers, shoots, and transfer points where there is no hook-usable position present. In some locations where there is no hook-usable position on a support surface, the magnet 26 of the adjustable drop light apparatus 10 of the invention enables using a drop light without using suspension ropes or wires.

The components of the adjustable drop light apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved adjustable drop light apparatus that is low in cost, relatively simple in design and operation, and which does not employ a removable and replaceable cap that contains a hook. With the invention, an adjustable drop light apparatus is provided which can be supported in a variety of orientations besides the longitudinal axis of the drop light. With the invention, an adjustable drop light apparatus is provided which has both a support magnet and a support hook for supporting a drop light. With the invention, an adjustable drop light apparatus is provided which has both an adjustable magnet and an adjustable hook so that the drop light can be oriented in a variety of orientations. With the invention, an adjustable drop light apparatus is provided which has both a magnet and a hook which share a common adjustable orientation assembly.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. An adjustable drop light apparatus, comprising:

a lamp assembly, a handle assembly connected to said lamp assembly, wherein said handle assembly supports said lamp assembly, a protective housing assembly, supported by said handle assembly, for protecting a portion of said lamp assembly, and a suspension assembly adjustably connected to said protective housing assembly, wherein said suspension assembly includes:

a magnet retainer, a magnet retained by said magnet retainer, and a hook assembly connected to said magnet, and wherein said magnet includes a retention well, said hook assembly includes a pivot bracket connected to said magnet within said retention well, and said hook assembly includes a selectably pivotable hook pivotally connected to said pivot bracket.

2. The apparatus of claim 1 wherein said suspension assembly includes:

an orientation adjustment assembly attached to said protective housing assembly.

3. The apparatus of claim 1 wherein:

said retention well has a well depth, said selectably pivotable hook has a hook thickness, and said well depth is greater than said hook thickness.

4. The apparatus of claim 1 wherein said lamp assembly and said handle assembly are connected together along a longitudinal axis.

5. The apparatus of claim 2 wherein said orientation adjustment assembly is positioned on said protective housing assembly parallel to said longitudinal axis.

6. The apparatus of claim 2 wherein said orientation adjustment assembly includes:

a captive rail connected to said protective housing assembly, and a head assembly connected to said suspension assembly, wherein said head assembly includes a head portion adapted to be captured by said captive rail.

7. The apparatus of claim 6 wherein said head assembly further includes:

a lock nut supported by said suspension assembly, a body portion adjustably connected to said lock nut, and a head portion connected to said body portion.

8. The apparatus of claim 7 wherein said suspension assembly includes a lock-retention portion for retaining said lock nut.

* * * * *